US011491676B2

(12) United States Patent
Jenter

(10) Patent No.: US 11,491,676 B2
(45) Date of Patent: Nov. 8, 2022

(54) CUTTING MACHINE WITH POSITIVELY CONTROLLED PRESSING AND CUTTING PROCESS

(71) Applicant: Krug & Priester GmbH & Co. KG, Balingen (DE)

(72) Inventor: Holger Jenter, Balingen (DE)

(73) Assignee: Krug & Priester GmbH & Co. KG, Balingen (DE)

( * ) Notice: Subject to any disclaimer, the term of this patent is extended or adjusted under 35 U.S.C. 154(b) by 0 days.

(21) Appl. No.: 17/654,590

(22) Filed: Mar. 12, 2022

(65) Prior Publication Data

US 2022/0297332 A1 Sep. 22, 2022

(30) Foreign Application Priority Data

Mar. 17, 2021 (EP) ..... 21163028

(51) Int. Cl.
*B26D 7/02* (2006.01)

(52) U.S. Cl.
CPC ..... *B26D 7/025* (2013.01)

(58) Field of Classification Search
CPC . B26D 7/025; B26D 7/02; B26D 7/01; B26D 7/04; B65H 2301/415095; B65H 2301/41722
See application file for complete search history.

(56) References Cited

U.S. PATENT DOCUMENTS 2,492,330 A * 12/1949 Smith ..... F16P 3/001 83/528
2,570,873 A * 10/1951 Seybold ..... B26D 7/04 83/543

FOREIGN PATENT DOCUMENTS

DE 19 52 742 A1 4/1971
DE 20 2008 013 651 U1 4/2010
GB 721 619 A 1/1955

* cited by examiner

*Primary Examiner* — Evan H Macfarlane
*Assistant Examiner* — Liang Dong
(74) *Attorney, Agent, or Firm* — Hackler Daghighian Martino & Novak

(57) ABSTRACT

A cutting machine includes a cutting support for material to be cut, a vertically movable blade bar which bears a blade for cutting the cut material located thereon, a cutting drive for vertically moving the blade bar, a vertically movable clamping bar for pushing down the material to be cut and a pressing drive for vertically moving the clamping bar. The cutting drive and the pressing drive are formed by a single drive which rotates a cam disc to and fro, wherein the blade bar is motion-coupled to the cam disc via a first coupling mechanism which acts on the cam disc eccentrically to the axis of rotation thereof. The clamping bar is motion-coupled to the cam disc via a second coupling mechanism, the one end thereof acting on the outer contour of the cam disc.

17 Claims, 2 Drawing Sheets

CUTTING MACHINE WITH POSITIVELY CONTROLLED PRESSING AND CUTTING PROCESS

CROSS-REFERENCE TO RELATED APPLICATIONS

This application claims priority to European Application No. 21 163 028.0, filed Mar. 17, 2021, the entire contents of which are hereby incorporated in full by this reference.

DESCRIPTION

Field of the Invention

The invention relates to a cutting machine with a cutting support for material to be cut, with a vertically movable blade bar which bears a blade for cutting the cut material located thereon, with a cutting drive for vertically moving the blade bar, with a vertically movable clamping bar for pushing down the material to be cut and with a pressing drive for vertically moving the clamping bar. The cut material may be, for example, a paper stack.

Background of the Invention

Nowadays there are various functional principles in electrically driven cutting machines, both for the cut material pressing and for the cutting blade drive. These functional principles may be partially assigned to specific machine size groups, since here they represent in each case the best compromise between function and costs.

The smaller cutting machines have a special status, since the forces required for the actuation of the cut material pressing are not particularly high in comparison with larger machines, so that often the muscular strength of the operator is sufficient and no motorized assistance is required. These machines are often not production machines operated by the operator all day long. A typical application of such machines is, for example, in copy shops. In this case, the partial or full electrification often serves primarily for greater convenience, since the expenditure of force by the operator is reduced and it is also possible to work more rapidly over a long period of time. Since the small machine segment is particularly price-sensitive, the production costs for the respective functional principle are paramount here and must not be too high relative to the manual machine variant. Thus generally only simple systems of electrification are used here, in some cases only the blade drive is driven by motor. If the cut material pressing is also driven by motor, the pressing force is generally not able to be adjusted. The machines of this machine group are not targeted in the examination below.

Cutting machines of the medium-sized machine group are very widely used, starting with professional copy shops via in-house print shops to professional print shops. These machines are particularly suitable for smaller and medium-sized paper formats which are frequently used in digital printing methods. For this reason, this medium-sized machine group has gained market importance and the required professionalism. The market increasingly requires here equipment features and working speeds which hitherto were primarily reserved for machines of the large-sized machine group. The equipment features, however, are generally not able to be implemented in the medium-sized machine group segment by the technologies of the large-sized machine group. The reasons for this are, for example, the overall size, the complexity and the price for implementing the equipment features. Machines of the medium-sized machine group are designed to be able to be operated on the standard safe-guarded single-phase power supply network, since this is available virtually at all desired points of use. The energy efficiency of such machines is important for many reasons. One reason is that, from the perspective of environmental protection and operating costs, the required energy consumption should be kept as low as possible, as in all electrically operated machines. A further reason is that the single-phase electrical wiring system of the building, which is used as desired, limits the potential power consumption and thus the capacity of the machine. In other words, the more energy-efficiently the machine operates, the more power may be used productively for the actual machine function.

In the case of purely electromechanical cutting and pressing drives, the blade and the cut material pressing are driven electromechanically, if required independently of one another.

Advantages:

High level of efficiency due to the drive of the mechanical blade movement and the mechanical cut material pressing by means of geared motors.

Complex and expensive hydraulic technology with a hydraulic system and complex control, etc. is not required.

Mechanically simple safety technology which prevents the cutting cycle being performed more than once after actuating the activation buttons.

Drawbacks:

The operator generally has no option of varying the pressing force for the cut material pressing as required.

If the cut material pressing is able to be activated separately and creates the same pressure as during the cutting process, the cut material pressing has to be considered equally to the blade drive in terms of safety technology. This means that when the cut material pressing device is lowered, the operator is not able to handle the cut material since an intervention in the safety-relevant region either has to be mechanically prevented by means of a cover or, when safeguarded by means of a light barrier, the cut material pressing is at a standstill or travels upwardly again as soon as an intervention is made by the operator.

It is also not generally provided in these systems that when the cut material pressing is activated separately it moves to a desired end position at the speed desired by the operator. The cut material pressing device is generally lowered onto the cut material at the speed fixed for the pressing/cutting cycle.

If separate motors are used for the cut material pressing and the blade drive, this has the drawback that the two required motors and the additionally required control technology for both systems increase the overall production costs.

In the case of fully hydraulic cutting and pressing drives, the blade and the cut material pressing are actuated in each case via a hydraulic cylinder. The required oil flow rate and the required oil pressure are provided by means of a hydraulic system consisting of a pump and an oil tank. The hydraulic cylinders are supplied with the required oil quantity and the desired oil pressure via a control unit at the correct time in the functional sequence.

Advantages:

The pressure for the cut material pressing may generally be adjusted by the operator and thus the pressing force on the cut material may be varied as desired.

This operating principle makes it possible to produce a foot pressing using reasonable technical effort. This enables the operator to lower the cut material pressing device onto the cut material by means of a foot pedal, independently of the hydraulic compression, and at the same time to handle the cut material located therebelow in position as required.

Drawbacks:

Relatively high part costs for the production and complex control of the required hydraulic pressure for the cutting and pressing drive.

The overall efficiency of a hydraulic blade drive is significantly worse than in the case of an electromechanical direct drive. For the blade drive, a control of the oil pressure and thus the cutting force, in contrast to the cut material pressing and the desired pressing force adjustment, is not required or advantageous.

Complex safety technology is necessary, which prevents a plurality of cutting cycles from being able to be performed after the activation buttons are actuated.

In the case of an electromechanical blade drive with a hydraulic cut material pressing drive branched off therefrom, the blade drive is implemented purely electromechanically by means of a motor which drives a crankpin. This crank drive brings about the upward and downward movement of the blade. At the same time, a piston of a hydraulic cylinder (master cylinder) is moved via the crank drive. As a result, a flow of hydraulic oil which is replaced in the hydraulic system is generated. A further hydraulic cylinder (slave cylinder) which drives the cut material pressing is supplied via a complex control unit.

Advantages:

The pressure for the cut material pressing may generally be adjusted by the operator and thus the pressing force on the cut material may be varied as desired.

The cost-intensive hydraulic system is dispensed with and as a result the production costs are reduced.

The blade drive is implemented with a high degree of electromechanical efficiency.

Mechanically simple safety technology which prevents the cutting cycle from being performed more than once after the activation buttons are actuated.

Simple possibility for integrating a foot pressing functionality.

Drawbacks:

Relatively high part costs for the complex control of the hydraulic pressing drive.

Two hydraulic cylinders (master and slave cylinder) are required.

SUMMARY OF THE INVENTION

Accordingly, it is the object of the present invention to simplify the structure in a cutting machine of the type mentioned in the introduction and to eliminate the aforementioned drawbacks of the prior art. In particular, a foot pressing of the clamping bar is designed to be decoupled from the electromotive pressing drive of the clamping bar.

This object is achieved according to the invention in that the cutting drive and the pressing drive are formed by a single drive (for example an electromotive drive motor) which rotates a cam disc to and fro, and in that the blade bar is motion-coupled to the cam disc via a first coupling mechanism which acts, in particular is articulated, on the cam disc eccentrically to the axis of rotation thereof, and the clamping bar is motion-coupled to the cam disc via a second coupling mechanism, the one first end thereof bearing against the outer contour of the cam disc.

According to the invention, the cut material pressing and the cutting of the cut material are positively coupled via the cam disc and as a result are able to be controlled more easily in terms of safety technology.

Advantageously, the outer contour of the cam disc is configured such that in the forward mode of the drive motor the clamping bar always moves downwardly in advance of the blade. As a result, it is ensured that the blade is always covered by the clamping bar until it penetrates the cut material (operational safety, for example in the case of a power separation during the pressing/cutting process).

Particularly preferably, the outer contour of the cam disc has, viewed in the forward direction of rotation, a front contour portion, and a rear contour portion, wherein the front contour portion rises more steeply radially outwardly than the rear contour portion. Preferably, the outer contour of the cam disc is configured in this case such that the creation of the desired pressing force during the pressing process is virtually completed by the start of the cutting process and is maintained during the cutting process. The cam contour of the cam disc starts with a steeply rising path on the front contour portion. Thus the pressing force is created as rapidly as possible before the cutting force is required. As a result, both functions may be operated with one drive motor. Since this occurs with a time delay, the drive motor does not have to provide the power for both functions at the same time and thus does not have to be of a larger size. The contour of the cam disc after the initial steep rise on the rear contour portion has only a slight gradient in order to compensate for a pressure drop in the hydraulic system of the hydraulic device caused by a leakage of oil. Overall, this results in an optimized energy efficiency and power distribution during the pressing/cutting process relative to the maximum available power consumption on a standard safeguarded single-phase power supply.

Preferably, the first coupling mechanism has a connecting rod which acts, in particular is articulated, on the cam disc eccentrically to the axis of rotation thereof, and the second coupling mechanism has a piston/cylinder hydraulic device or a compression spring, the one first end thereof bearing or rolling on the outer contour of the cam disc, in particular by means of a guide roller.

Preferably, the piston/cylinder hydraulic device has a pressure control valve in order to adjust the (hydraulic) pressure which is required in order to push a piston into a pressing cylinder of the hydraulic device. The adjustment of the desired pressing force is achieved by the adjustment of the maximum pressure on the pressure control valve. The adjustment may take place either manually via an adjusting element fastened to the pressure control valve or electrically via an electromotively driven adjusting element. It is possible for the piston to displace the oil present in the pressing cylinder into a hydraulic oil tank only by means of the pressure adjusted on the pressure control valve. This pressure is proportional to the pressing force on the cut material.

Advantageously, the piston of the piston/cylinder hydraulic unit is subjected continuously, i.e. during the entire pressing/cutting cycle, to a pushing-out force which pushes the piston out of the cylinder hydraulic unit. The pushing-out force may be provided, for example, by a compression spring or a gas pressure spring unit or by a permanent overpressure in the piston/cylinder hydraulic unit. The clamping bar is pressed onto the cut material by the pushing-out force until the cam disc and therewith the piston of the piston/cylinder hydraulic unit have moved back sufficiently far until this piston has arrived in its extended position and in a positively coupled manner entrains the clamping bar upwardly into the initial position thereof.

Particularly preferably, the cutting machine has a foot pedal for the manual vertical movement of the clamping bar, said foot pedal being motion-coupled both to the clamping bar and to the other second end of the second coupling mechanism, in order to lift away the first end of the second coupling mechanism from the outer contour of the cam disc by actuating the foot pedal. Preferably, in this case a foot pedal deflection linkage engages directly in a deflection mechanism which acts between the second coupling mechanism and the clamping bar. Thus the cut material pressing may be moved independently of the cam disc position, by actuating the foot pedal, in order to press the cut material manually.

Further advantages of the invention emerge from the description and the drawing. Moreover, the aforementioned features described in more detail hereinafter, according to the invention, may be used in each case individually per se or in any combinations thereof. The embodiments shown and described are not to be understood as a definitive list but rather have an exemplary nature for explaining the invention.

BRIEF DESCRIPTION OF THE DRAWINGS

The invention is shown in the drawings and is described in more detail with reference to an exemplary embodiment. In the drawings.

DETAILED DESCRIPTION OF THE PREFERRED EMBODIMENTS

Figure 1A:
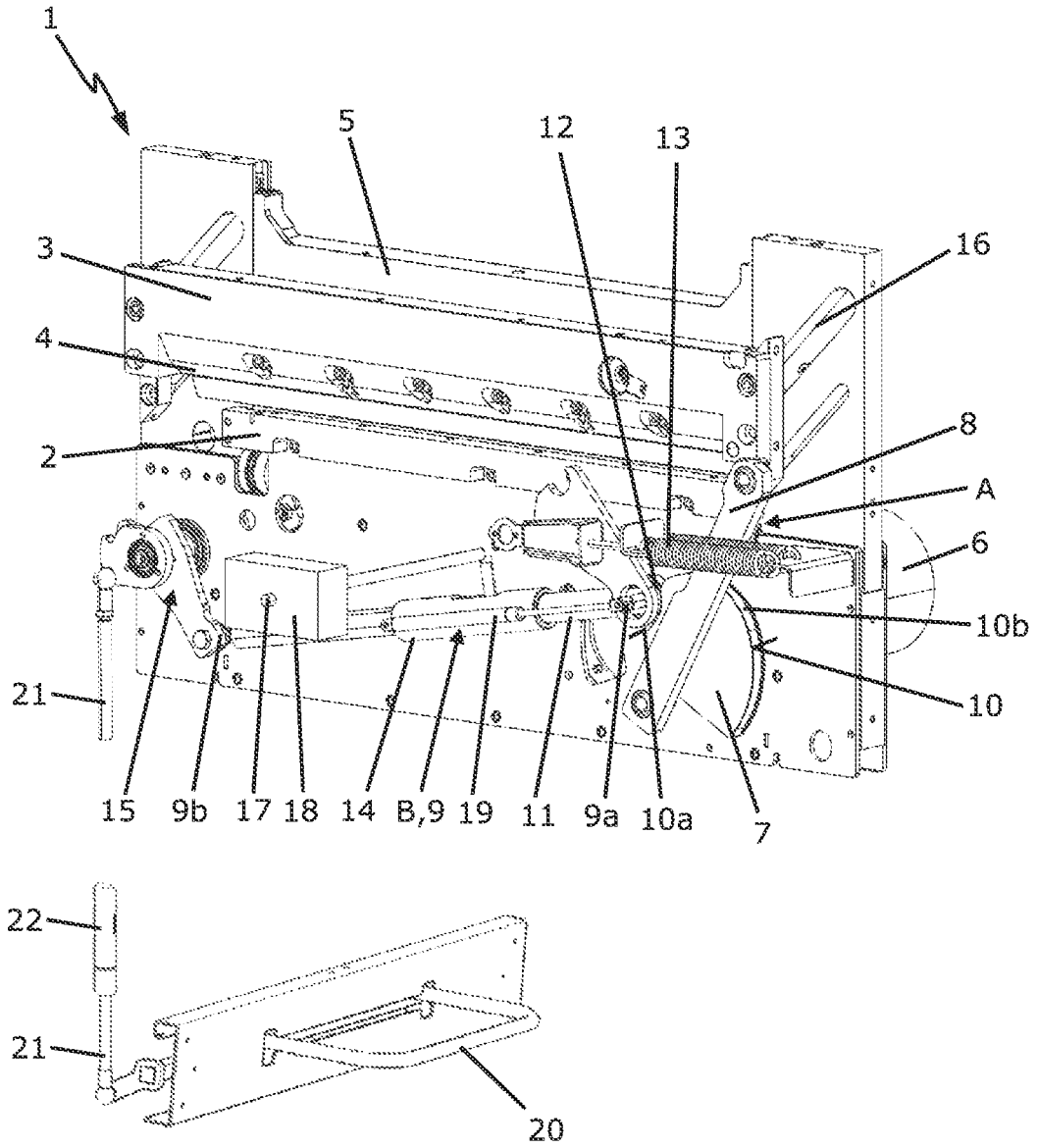
FIGS. 1*a*, 1*b* show a cutting machine according to the invention in a front view (FIG. 1*a*) and in a rear view (FIG. 1*b*), wherein in FIG. 1*b* a foot pedal for a manual actuation of a clamping bar of the cutting machine is not shown.
Figure 1B:
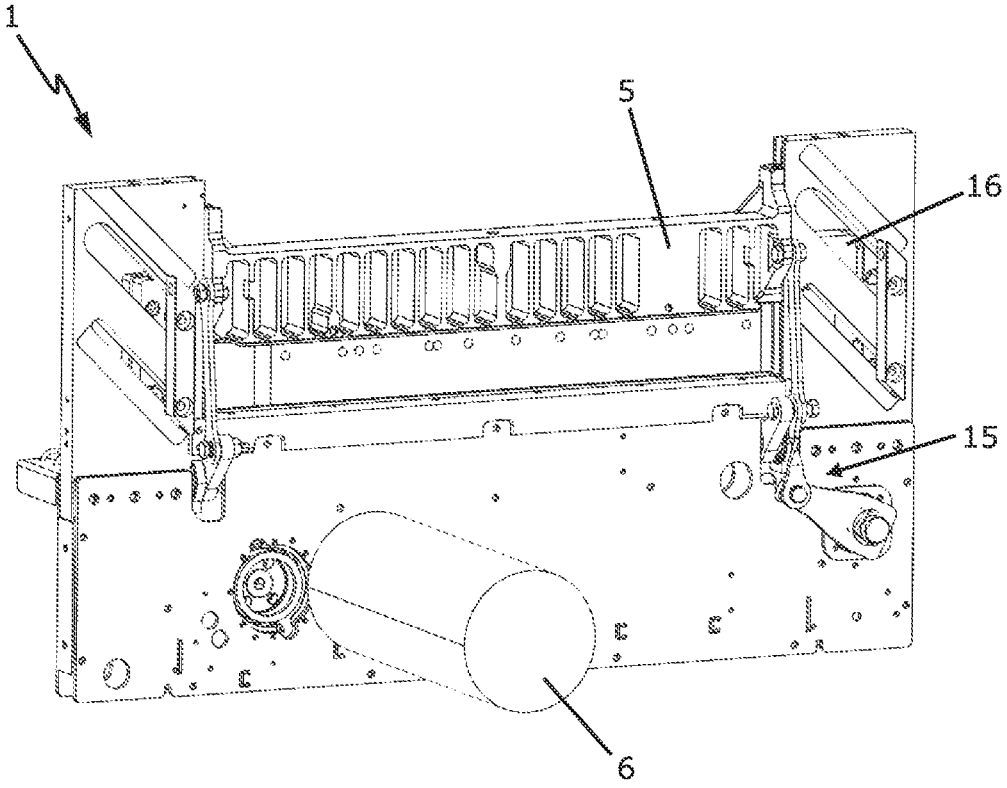

The cutting machine 1 shown in FIGS. 1*a*, 1*b* comprises a cutting support 2 for material to be cut, for example a paper stack, a blade bar 3 which is vertically movable (in this case obliquely downwardly) and which bears a blade 4 for cutting the material to be cut which is located thereon, a vertically movable clamping bar 5 for pushing down the material to be cut and a drive in the form of a drive motor 6 as a cutting drive for vertically moving the blade bar 3 and as a pressing drive for vertically moving the clamping bar 5.

The drive motor 6 rotates a cam disc 7 in each case by ca. 180° to and fro. The blade bar 3 is motion-coupled to the cam disc 7 via a first coupling mechanism A in the form of a connecting rod 8, which is articulated eccentrically on the cam disc 7 relative to the axis of rotation thereof. The clamping bar 5 is motion-coupled to the cam disc 7 via a second coupling mechanism B in the form of a piston/cylinder hydraulic device 9, the one first end 9*a* thereof bearing against the outer contour 10 of the cam disc 7. In the exemplary embodiment shown, the first end 9*a* is formed by the free end of a piston or a piston rod 11 of the hydraulic device 9, said free end bearing a guide roller 12. The guide roller 12 is pushed by means of a spring 13 so as to bear against the outer contour 10 of the cam disc 7. The end of a pressing cylinder 14 of the hydraulic device 9 remote from the piston rod 11 forms the other second end 9*b* of the hydraulic device 9, said second end being connected to a deflection mechanism 15 which actuates the clamping bar 5.

If the cutting is activated by actuating an electrical switch, for example, the drive motor 6 which rotates the cam disc 7 starts up, the connecting rod 8 for the blade actuation also being fastened thereto in a rotationally movable manner. The fastening of the connecting rod 8 to the cam disc 7 takes place at a distance from the axis of rotation of the cam disc 7 so that the cam disc 7 functions as a crankshaft. If the cam disc 7 rotates, the connecting rod 8 is pulled downwardly. The other end of the connecting rod 8 is rotatably fastened to the blade bar 3 and pulls this blade bar downwardly together with the blade 4 within an oblique guide slot 16 for the cutting process.

The outer contour 10 of the cam disc 7, i.e. the radial distance from the axis of rotation, is designed such that in forward mode the clamping bar 5 always moves downwardly in advance of the blade 4. The clamping bar 5 thus always protrudes downwardly over the blade 4 until it bears against the cut material and starts the actual cutting process. As a result, the operator safety is increased in the event that the pressing/cutting process is stopped (for example by switching off the main switch) before the blade 4 comes into engagement with the cut material.

The outer contour 10 of the cam disc 7 has, viewed in the forward rotational direction, a front contour portion 10*a* and a rear contour portion 10*b*. In this case, the front contour portion 10*a* rises radially outwardly more steeply than the rear contour portion 10*b*. The gradient of the outer contour 10 is thus very steep at the start, so that the pressing process is virtually completed by the start of the cutting process. Thus the available motor power of the drive motor 6 during the pressing/cutting process is divided into time periods such that in each case virtually the entire motor power is available for the two sub-processes. The hybrid functionality consisting of the electromechanical blade direct drive which is optimal for the cutting process and the pressing force which is optimal for the cut material pressing process which is able to be hydraulically adjusted over a wide range, is implemented by simply one drive motor 6 and one pressing cylinder 14 and thus at low cost.

The pressing cylinder 14 is directly connected to the deflection mechanism 15 of the cut material pressing and the piston rod 11 is coupled via the guide roller 12 to the outer contour 10 of the cam disc 3. The pressing cylinder 14 thus itself forms a part of the deflection mechanism 15 and moves as a whole until the cut material is reached during the pressing process. Then only the piston rod 11 moves substantially relative to the pressing cylinder 14 in order to create the adjusted pressing force.

The mode of operation of the cutting machine 1 is as follows:

1. Motor forward mode: pressing and cutting are activated:

1.1 Functional sequence part 1—the clamping bar 5 meets no resistance: The cam disc 7 rotates and thereby displaces the guide roller 12 together with the piston rod 11. Thus the piston rod 11 moves according to the shape of the cam disc 7. Since the clamping bar 5 is freely movable, the deflection mechanism 15 fastened thereto and the pressing cylinder 14 are also freely movable. Thus the pressing cylinder 14 may move to the same extent as the piston rod 11. In other words, the piston rod 11 is not pushed into the pressing cylinder 14. Thus no oil is displaced in the pressing cylinder 14 and thus no oil pressure is created in the system.

1.2 Functional sequence part 2—the clamping bar 5 meets the resistance of the introduced cut material: The clamping bar 5 is then no longer freely movable downwardly, since it bears against the cut material. Thus the deflection mechanism 15 and therewith the pressing cylinder 14 may also no longer freely move. If the piston rod 11 is now displaced further via the cam disc 7, the pressing cylinder 14 may not move to the same extent as the piston rod 11 and the piston rod 11 is pushed into the pressing cylinder 14. The oil in the pressing cylinder 14 is displaced and via a pressure control valve 17 discharged into a hydraulic oil tank 18. The adjusted control pressure on the pressure control valve 17 determines the force which is required in order to push the piston rod 11 into the pressing cylinder 14. The greater the adjusted pressure, the greater the required force. Thus the force rises with the control pressure, and in turn this means as a counter reaction that the pressure, at which the clamping bar 5 is pressed onto the cut material, also changes via the deflection mechanism 15. The adjustment of the desired pressing force is achieved by the adjustment of the maximum pressure on the pressure control valve 17. This adjustment may take place either manually via an adjusting element fastened to the pressure control valve 17 or electrically via an electromotively driven adjusting element. All of the oil to be displaced is conveyed into the tank at the maximum adjusted pressure. Thus a complex and thereby expensive control unit, which when reaching the desired limit pressure maintains this pressure during the pressing cycle in the system and permits the remaining oil to flow in an unpressurized manner into the tank, is not required.

The chronological sequences of the functional sequences of parts 1 and 2 are dependent on the height of the introduced cut material:

In the case of a low introduction height or cutting height, i.e. with a small amount of cut material, the clamping bar 5 and therewith the deflection mechanism 15 and the pressing cylinder 14 may move freely over a large part of the clamping bar movement path, until the clamping bar bears against the cut material. This has the result that the piston rod 11 is pushed only at the end of the pressing process and merely to a small degree into the pressing cylinder 14. Thus only a little oil is displaced in the pressing cylinder 14 and conveyed into the tank. The adjusted overflow pressure during the cutting/pressing cycle is thus only briefly in the system. In the case of a full introduction height or cutting height, i.e. with a large amount of cut material, the clamping bar 5 and therewith the deflection mechanism 15 and the pressing cylinder 14 may freely move only over a small portion of the clamping bar movement path until the clamping bar bears against the cut material. This has the result that already at the start of the pressing process the piston rod 11 is pushed virtually completely into the pressing cylinder 14. Thus virtually all of the oil in the pressing cylinder 14 is displaced and conveyed into the hydraulic oil tank 18. The adjusted overflow pressure during the cutting/pressing cycle is thus present in the system over a long period of time.

2. Motor reverse mode: the pressing/cutting process is terminated, the system has reached the adjusted reversal point and moves back into the initial position by the drive motor 16 changing the rotational direction:

The guide roller 12 acted upon by a spring follows the rotating outer contour 10 of the cam disc 7 which is deflected increasingly less by the cam path thereof in contrast to forward mode. The piston rod 11 fastened to the guide roller 12 thus also moves. The piston rod 11 is pulled out of the pressing cylinder 14. This has the result that oil is suctioned out of the hydraulic oil tank 18. The pressure control valve 17 is to this end bypassed in the opposing direction of flow by a non-return valve (not shown) so that the oil may be suctioned in a virtually unpressurized manner from the hydraulic oil tank 18. If during reverse mode the piston rod 11 has arrived at its extended end position, the pressing cylinder 14 and the clamping bar 5 connected via the deflection mechanism 15 have to follow the piston rod in a positively coupled manner to the upper initial position of the clamping bar 5.

With the reverse mode of the system, at the start the clamping bar 5 only acts counter to the gravitational force thereof. In some cases, this is not sufficient, however, in order to compensate for the frictional forces of the remaining system (such as for example due to the piston seals). This may lead to the clamping bar 5 either immediately lifting away or at least no longer bearing securely against the cut material, until the blade 4 has arrived in the upper initial position. This is a problem, for example, when cutting cut material which is provided with a self-adhesive film. This cut material tends to adhere slightly to the blade 4 and, if not secured during the return travel of the blade, may slip due to the adhesion. In order to prevent this, the clamping bar 5 may fix the cut material until the blade 4 has arrived again approximately in its upper initial position. Thus it is advantageous to press the clamping bar 5 with a certain fixed force onto the cut material until the cam disc 7 and therewith the piston of the piston/cylinder hydraulic unit 9 have moved back sufficiently far that said piston has arrived in the extended position thereof and in a positively coupled manner entrains the clamping bar 5 upwardly into the initial position thereof. This may be implemented by the technology that the piston of the piston/cylinder hydraulic unit 9 is subjected continuously, i.e. during the entire pressing/cutting cycle, to a force which pushes the piston out of the cylinder hydraulic unit 9. This pushing-out force leads to the cut material being fixed with the predetermined pressing force via the clamping bar 5 coupled to the piston/cylinder hydraulic unit 9 until the cam disc 7 and therewith the positively coupled blade bar 3 together with the blade 4 have arrived approximately in the upper initial position thereof. In the further movement sequence, the piston/cylinder hydraulic unit 9 and therewith the clamping bar 6 are pulled upwardly into the initial position thereof.

The pushing-out force may act, for example, on the piston by means of a compression spring 19 or gas pressure spring unit, wherein the compression spring 19 or gas pressure spring unit may be mounted inside or, as shown in FIG. 1*a*, outside the piston/cylinder hydraulic unit 9. A further exemplary embodiment may be achieved by a permanent overpressure in the piston/cylinder hydraulic unit 9 which acts as a corresponding spring and pushes the piston permanently with a defined force out of the piston/cylinder hydraulic unit 9.

FIG. 1*a* shows a foot pedal 20 for a manual actuation of the clamping bar 5. If the foot pedal 20 is moved downwardly via the foot pedal deflection linkage 21, the clamping bar 5 is pulled downwardly, i.e. in the direction of the introduced cut material. The foot pedal 20 is motion-coupled both to the clamping bar 5 and to the second end 9*b* of the hydraulic device 9 in order to lift away the first end 9*a* of the hydraulic device 9 from the outer contour 10 of the cam disc 7 by actuating the foot pedal 20.

The clamping bar 5 may thus be actuated independently of the electrical pressing/cutting cycle and thus independently of the safety control. This means that when actuating the pressing by means of the foot pedal 20 the operator may handle the paper stack with the pressing device lowered, although the operator is moving in the monitored safety region of the machine. This is permitted since the pressing force is applied by the operator himself by means of the leg pressure thereof. If required, the operator may force out the air between the individual layers of the cut material before the automatic pressing/cutting cycle in a targeted manner by means of the foot pressing device, or may see accurately over the front edge of the lowered clamping bar 5 where the cutting has taken place by the blade arranged directly in front of the clamping bar 5. If required, the operator may realign the cut material when the clamping bar 5 is lowered.

The decoupling of the foot pressing device from the automatic pressing device is possible mechanically, since when actuating the foot pressing device the deflection mechanism 15 of the pressing mechanism is moved such that the clamping bar 5 is lowered in the direction of the cut material. By means of the deflection mechanism 15 the pressing cylinder 14 fastened thereto also moves with the piston rod 11 together with the guide roller 12. This guide roller lifts away counter to the force of the spring 13 from the outer contour 10 of the cam disc 7. Thus the hydraulic device 9 is moved independently of the position of the cam disc 7.

If the automatic pressing/cutting process is activated when the foot pressing is actuated, this pressing/cutting process runs as described above. However, at the start of the pressing/cutting process the guide roller 12 and therewith the entire remaining hydraulic device 9 do not bear against the outer contour 10 of the cam disc 7. In other words, without starting the automatic pressing process, the blade 4 is moved downwardly until the cam disc 7 has rotated sufficiently far that the guide roller 12, lifted away by the foot pressing, again comes to bear against the outer contour 10 of the cam disc 7. Only then the adjusted pressing force is created in the system and the blade 4 comes into engagement with the cut material.

Optionally, the foot pedal deflection linkage 21 may have a gas pressure spring 22. When actuating the foot pedal 20 the gas pressure spring 22 does not retract, i.e. it acts in the manner of a rigid linkage, until a fixed maximum actuating force (fixed spring force of the gas pressure spring 22) is reached. If this maximum actuating force is exceeded, the gas pressure spring 22 is compressed without the remaining system being additionally stressed, until the foot pedal 20 bears against the floor.

Instead of the piston/cylinder hydraulic device 9 shown, alternatively a compression spring which is compressed in the pressing sequence may also be used (instead of pushing in the piston 11 against the adjusted overflow pressure). The pressing force may then be adjusted within certain limits via the pretensioning of the compression spring. The compression spring has to be limited in its maximum extension—as is the piston/cylinder hydraulic unit 9—since otherwise it would permanently actuate the pressing. To this end, the compression spring either may be completely relaxed in the resting position (the pressing device is in the upper end position) or previously pretensioned by means of a spring path limiter. As a spring path limiting element, for example, a cross member may be installed, running in the centre of the compression spring, washers which limit the compression spring in the maximum extension thereof being located at the ends thereof. The compression spring variant thus follows the cam disc only when it is pretensioned by means of the force of the spring 13 against the outer contour 10 of the cam disc 7.

What is claimed is:

1. A cutting machine comprising:

a cutting support for material to be cut;

a vertically movable blade bar which bears a blade for cutting the cut material located on the cutting support;

a cutting drive for vertically moving the blade bar;

a vertically movable clamping bar for pushing down the material to be cut and a pressing drive for vertically moving the clamping bar;

wherein the cutting drive and the pressing drive are formed by a drive which rotates a cam disc to and fro, and wherein the blade bar is motion-coupled to the cam disc via a first coupling mechanism which acts on the cam disc eccentrically to the axis of rotation of the cam disc, and the clamping bar is motion-coupled to the cam disc via a second coupling mechanism having a first end and a second end which are opposite to one another, the first end of the second coupling mechanism acting on an outer contour of the cam disc; and a foot pedal configured for vertical movement of the clamping bar, said foot pedal being motion-coupled both to the clamping bar and to the second end of the second coupling mechanism, in order to lift away the first end of the second coupling mechanism from the outer contour of the cam disc by actuating the foot pedal.

2. The cutting machine according to claim 1, wherein the outer contour of the cam disc is configured such that in a forward direction of rotation of the drive the clamping bar always moves downwardly in advance of the blade.

3. The cutting machine according to claim 2, wherein the outer contour of the cam disc, viewed in a forward direction of rotation, has a front contour portion, and a rear contour portion, wherein the front contour portion rises more steeply radially outwardly than the rear contour portion.

4. The cutting machine according to claim 1, wherein the outer contour of the cam disc, viewed in a forward direction of rotation, has a front contour portion, and a rear contour portion, wherein the front contour portion rises more steeply radially outwardly than the rear contour portion.

5. The cutting machine according to claim 1, wherein the outer contour of the cam disc is configured such that the creation of the desired pressing force during the pressing process is virtually completed by the start of the cutting process and is maintained during the cutting process.

6. The cutting machine according to claim 1, wherein the first coupling mechanism has a connecting rod which acts on the cam disc eccentrically to the axis of rotation of the cam disc.

7. The cutting machine according to claim 1, wherein the second coupling mechanism has a piston/cylinder hydraulic device or a compression spring, the first end of the second coupling mechanism bearing on the outer contour of the cam.

8. The cutting machine according to claim 7, wherein the first end of the second coupling mechanism is pretensioned by the force of a spring so as to bear against the outer contour of the cam disc.

9. The cutting machine according to claim 8, wherein the piston/cylinder hydraulic device has a pressure control valve in order to adjust the control pressure which is required in order to push a piston into a pressing cylinder of the piston/cylinder hydraulic device.

10. The cutting machine according to claim 8, wherein a piston of the piston/cylinder hydraulic unit is subjected during the entire pressing/cutting cycle to a pushing-out force which pushes the piston out of the cylinder hydraulic unit.

11. The cutting machine according to claim 7, wherein the piston/cylinder hydraulic device has a pressure control valve in order to adjust the control pressure which is required in order to push a piston into a pressing cylinder of the piston/cylinder hydraulic device.

12. The cutting machine according to claim 11, wherein the piston of the piston/cylinder hydraulic unit is subjected during the entire pressing/cutting cycle to a pushing-out force which pushes the piston out of the cylinder hydraulic unit.

13. The cutting machine according to claim 7, wherein a piston of the piston/cylinder hydraulic unit is subjected during the entire pressing/cutting cycle to a pushing-out force which pushes the piston out of the cylinder hydraulic unit.

14. The cutting machine according to claim 13, wherein the pushing-out force is provided by a compression spring or a gas pressure spring unit.

15. The cutting machine according to claim 13, wherein the pushing out force is provided by a permanent overpressure in the piston/cylinder hydraulic unit.

16. The cutting machine according to claim 1, wherein a foot pedal deflection linkage engages directly in a deflection mechanics which acts between the second coupling mechanism and the clamping bar.

17. The cutting machine according to claim 16, wherein the foot pedal deflection linkage has a gas pressure spring.

* * * * *